United States Patent [19]

Hahn et al.

[11] 4,039,108

[45] Aug. 2, 1977

[54] FEEDING AND HOLD DOWN MECHANISM FOR A SANDING AND SHAPING MACHINE

[75] Inventors: Norman Hahn; Raymond G. Martin, both of East Earl, Pa.

[73] Assignee: Conestoga Wood Products, Inc., East Earl, Pa.

[21] Appl. No.: 680,713

[22] Filed: Apr. 27, 1976

[51] Int. Cl.[2] ..... B65H 17/34

[52] U.S. Cl. ..... 226/171; 271/275

[58] Field of Search ..... 226/170–173, 226/195, 167, 163, 164; 271/275; 269/254 R, 254 CS

[56] References Cited

U.S. PATENT DOCUMENTS

| | | | |
|---|---|---|---|
| 2,827,291 | 3/1958 | Wilson | 271/275 |
| 3,022,928 | 2/1962 | Ulmitz | 226/172 |
| 3,289,906 | 12/1966 | Schuller | 226/171 X |
| 3,620,432 | 11/1971 | Emery | 226/172 |

*Primary Examiner*—Richard A. Schacher
*Attorney, Agent, or Firm*—James J. Kennedy

[57] ABSTRACT

Apparatus for use in a sanding and shaping or other machine comprised of a plurality of individually mounted feeding and hold down members adapted to engage and hold a work piece against a table and against a guiding fence as the work piece is fed through the machine to keep the work piece from turning or binding in the machine.

8 Claims, 7 Drawing Figures

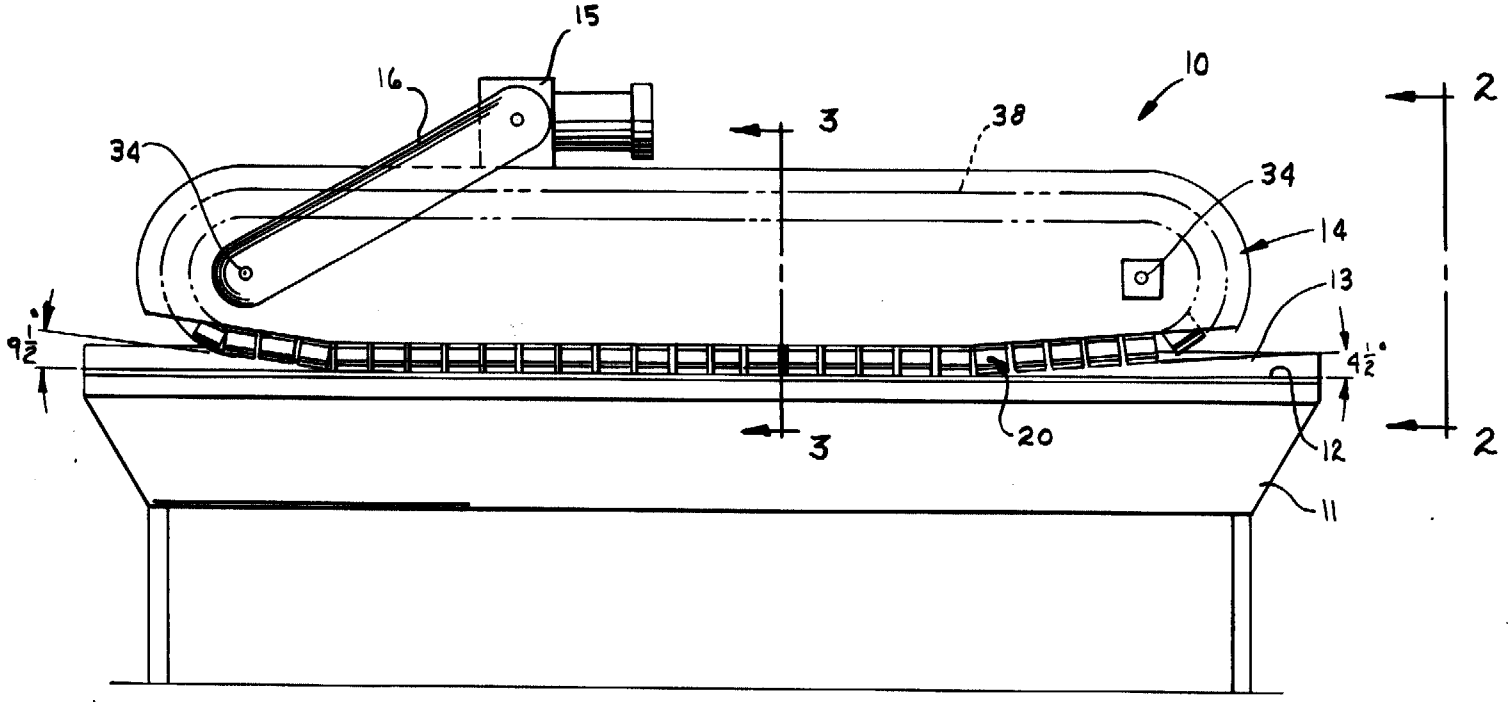
Fig I

FEEDING AND HOLD DOWN MECHANISM FOR A SANDING AND SHAPING MACHINE

BACKGROUND OF THE INVENTION

It has been customary in the woodworking arts to use automatic machinery wherever possible during the manufacturing operation to increase productivity. Sanding and shaping of the wood pieces can be accomplished readily using appropriate woodworking machines. One of the major difficulties in using such equipment, however, has been in providing appropriate feeding and holding means to permit gradual entry of the work piece into the machine and yet to hold it firmly as it passes through the point of operation in a way that will not leave marks on the surface of the work piece. Many different means have been used in the equipment to engage the work piece and hold it steady as it is fed into the machine and as it passes through. It is of utmost importance that as the work piece enters the machine it not be allowed to move or turn with respect to the tool being used at the point of operation in the machine, especially if some sort of ornamental surface is to be formed in the work piece. In hand fed operations, a binding or other movement of the work piece as the work is performed is kept under control by the individual operator. With the automatic machinery, however, the operator is usually prevented from placing his hands in the machine to keep the work piece from moving.

The prior art feeding devices have used individual hold down members or various types of belts or other such members. None of these devices have proved particularly satisfactory, because none of the previously known hold down devices are able to apply sufficient pressure to the work piece to keep it from binding or moving as it passes through the machine and not leave some sort of mark on the surface of the work piece which would detract or render the work piece unusable in a further manufacturing operation.

SUMMARY OF THE INVENTION

One of the principle objects of the present invention is to provide a hold down mechanism which is comprised of individually mounted members which apply both a vertical and a horizontal component of force to the work piece as it travels through the machine.

Another object of the invention is to provide a feeding and hold down mechanism which can yield vertically to accept work pieces of varying thicknesses.

A further object of the invention is to provide a resilient surface between the pressure applying portion of the feeding and hold down mechanism and the work piece which will not mar or mark the work piece as it is held in place while being fed through the machine.

A still further object of the invention is to provide for individual members which can easily be removed from the machine when repairs or replacement is necessary.

Another object of the invention is to provide a feeding mechanism which gradually engages the work surface clamping down on the work piece to hold it in place as it is being fed through the machine. Similarly, the hold down devices gradually disengage from the work piece after it passes through the machine so that there is no abrupt force applied to cause it to turn or bind as it is fed into or exits from the point of operation.

These and other objects of the invention will become more apparent from the following detailed description and the accompanying drawings.

BRIEF DESCRIPTION OF THE DRAWINGS

FIG. 1 is an overall side view of the machine forming the subject of the present invention showing a plurality of individually mounted feeding and holding members above a work surface.

DESCRIPTION OF THE PREFERRED EMBODIMENT

Figure 3:
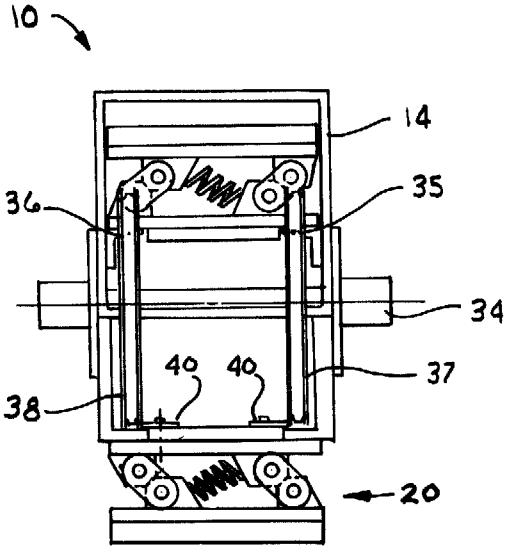
FIG. 3 is a section view taken on the line 3—shown in FIG. 1.

Referring now to the drawings, particularly to FIG. 1, the sanding and shaping machine is denoted generally by numeral 10 and is comprised of a base portion 11, a flat work surface 12 which extends the length of the machine, guide fence 13 which also extends the full length of the work surface 12 at a right angle thereto, feeding and hold down mechanism 14, power source 15 such as an electric motor or the like, and drive means 16 interconnecting the power source 15 with a drive sprocket on the feeding and hold down mechanism 14. It should be understood that the feeding and hold down mechanism 14 can be vertically adjusted as a unit with respect to the work surface 12 by means not shown to compensate for varying thickness of work piece. The guiding fence 13 is movable across the surface 12 to compensate for work pieces of varying width.

A work piece is fed into the machine at the right hand side, as the machine is viewed in FIG. 1 of the drawings, to a point where the work piece is below an individual feeding and hold down member 20. The feeding and hold down mechanism 14 is so constructed that it forms an approximately 4¼° angle of entry between the hold down members 20 and the work surface 12 as material is fed into the machine. This angle permits the work to be gradually engaged by the hold down members 20 so that the members 20 hold it firmly, but securely against the work surface 12 and the guide fence 13 as will be more fully described hereinafter.

Similiary, at the exit end of the machine, as shown at the left hand side of FIG. 1, there is a 9½° angle between the feeding and hold down mechanism 14 and work surface 12 to permit a speedy, uninterrupted withdrawal of members 20 from the work piece.

Figure 2:
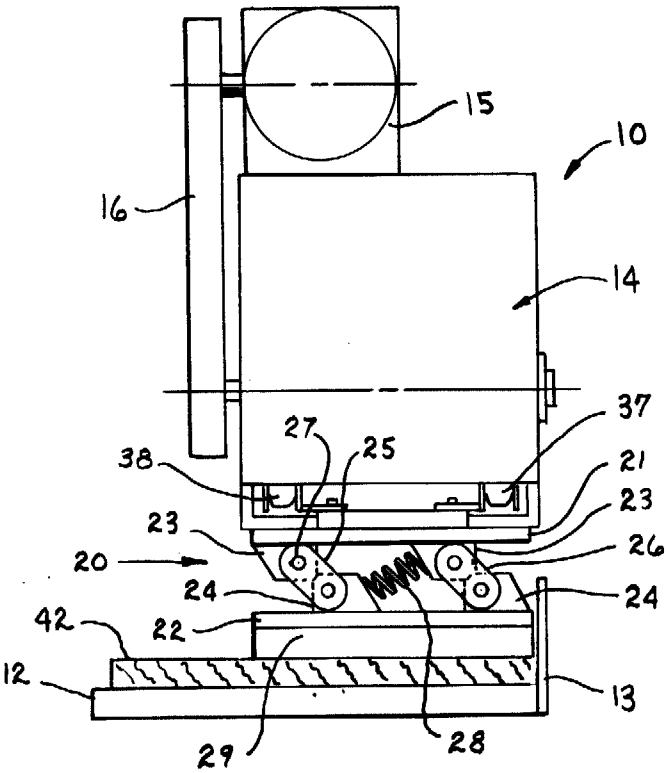
FIG. 2 is an end view of the machine shown in FIG. 1, showing an individual feeding and hold down member engaging a work piece and holding it in place against the work surface surface and a guide fence.
Figure 6:
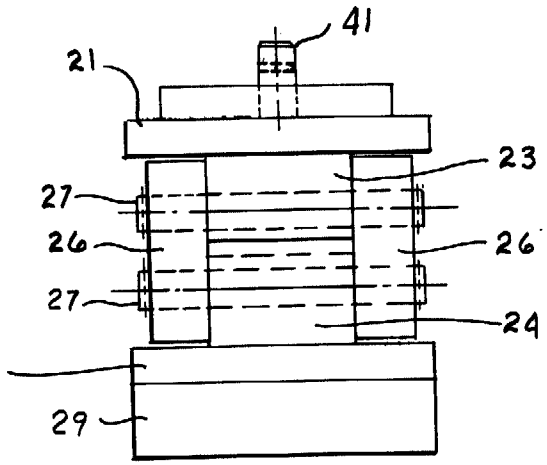
FIG. 6 is a side view of the feeding and holding member shown in FIG. 4.
Figure 4:
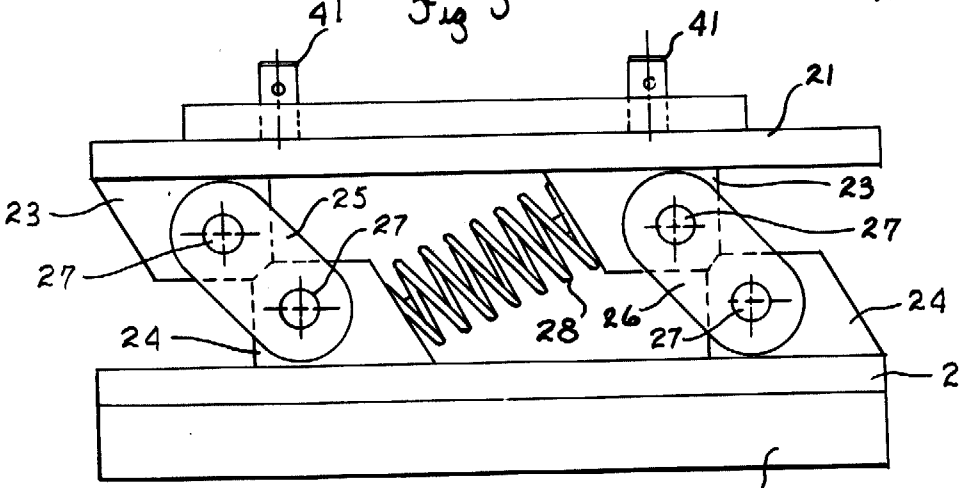
FIG. 4 is a detailed front view of a feeding and holding member.

As shown in FIGS. 2, 4 and 6 the feeding and hold down mechanism 14 is comprised, in part, of a plurality of individually suspended hold down members 20. Each of the members 20 is comprised of an upper plate portion 21, a lower plate 22, a pair of upper mounting pads 23 and an opposed pair of lower mounting pads 24. The mounting pads 23 are fixed to the upper plate 21 and depend therefrom. The mounting pads 24 are fixed to the lower plate 22 and extend upwardly toward the depending upper mounting blocks, as is specifically shown in FIGS. 2 and 4.

A first pair of arms 25 and a second pair of arms 26, each having a pair of spaced apart holes, are used to interconnect plates 21 and 22 and pads 23 and 24 so that the two plates are in parallel, spaced apart relation to each other at all times during the operation of the device. Four identical shafts 27 are adapted to be inserted in suitable holes in the pads 23 and 24 and to be rotatable therein. The shafts are long enough so that they extend out of the pads at each end, as shown in FIG. 6. The pairs of arms 25 and 26 are slipped over the ends of the shafts 27, being held in place by pins or other suitable means. The plate 22 is movable with respect to plate 21. The plates are pivotally interconnected by the arms 25 and 26 and pins 27.

A compression spring 28 extends between upper mounting pad 23 and lower mounting pad 24 in a diagonal fashion, as shown in FIGS. 2, 3 and 4. This compression spring is connected in any suitable fashion such as by set screws or other such means to the opposed pads.

Each member is provided with a resilient pad surface 29 which depends from lower plate 22 and is fixed suitably thereto. The resilient pad 29 may be a rubber material or a urethane material. This resilient pad portion of the member 20 is the actual portion of the feeding and hold down device which physically contacts the work piece, holding it in place as the work piece is fed through the machine.

In FIG. 3, it can be seen that the feeding and hold down apparatus 14 is further comprised of a pair of mounting shafts 34 at either end thereof which mounted in spaced apart relation. A pair of sprockets 35 and 36 are mounted on the shafts 34 and are adapted to engage and drive a pair of spaced apart chains 37 and 38 in a continuous loop.

Figure 5:
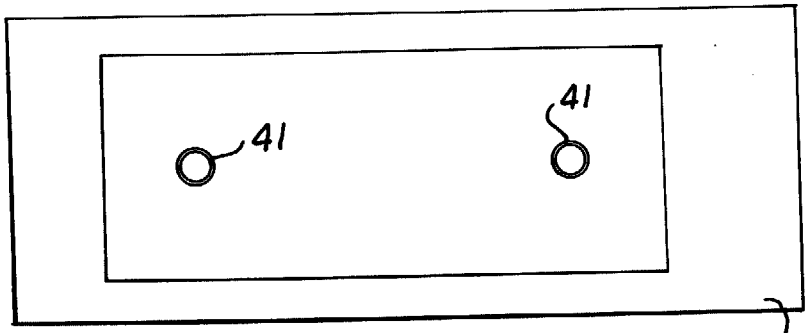
FIG. 5 is a top view of the feeding and holding member.

Mounting clips 40 are suitably fixed to the inside of the chains 37 and 38 and extend inwardly from the chains to a point where they are suitably affixed by bolts, cotter pins or suitable connections to the upper portion of plate 21, over studs 41, as shown in FIGS. 3, 4 and 5. In this way, a plurality of members 20 are mounted in side by side relation around the entire circumference of the chain loops to form a substantially continuous loop as the chain and hold down members rotate in the machine.

In operation, work piece 42, such as the piece shown in FIG. 2, is fed into the sanding and shaping machine 10 so that it is engaged by a first rotating feeding and holding member and is drawn into the machine. As the work piece is engaged by the member 20, the plate 22 yields upwardly and laterally with respect to the fixed plate 21 against the pressure of the spring 28.

As the lower plate moves, the arms 25 and 26 pivot to permit the plates 21 and 22 to remain in a parallel relation. Plate 22 yields upwardly only enough to provide clearance for the work piece beneath it.

The spring 28 urges the lower plate constantly down against the work piece so that the resilient pad member 29 is in contact with the surface of the work piece, holding the work piece securely against the horizontal work surface 12 and against the vertical fence 13 as it passes through the machine. As can readily be understood, it is this unique parallelogram construction of member 20 which imparts a vertical and a horizontal component of force to the work piece forcing the work piece downwardly against the table 12 and inwardly against the fence 13, so that the work piece is held in a relatively fixed position with respect to inner work imparting components of the machine, such as the shaping or sanding heads, as the piece passes through the machine.

Figure 7:
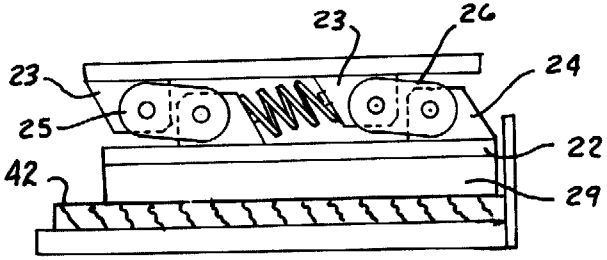
FIG. 7 is a detail view of a feeding and holding member showing the relationship of the various components when the member has yielded in the vertical direction when a piece of work is placed between it and a work surface.

The configuration of the various components as the hold down member 20 yields to engage a work piece 42 is shown in more detail in FIG. 7. As can be seen, the plate 22 and pad 29 move not only vertically with respect to plate 21, but also laterally. In this fashion, the hold down means provides the same force components to the work piece as would be applied by an operator, if the work piece was guided through the machine by hand.

As the work is completed and the work piece discharged from the machine, the exit angle of 9½° permits the individual members 20 to gradually disengage from the work piece so that, again, there is no binding or turning motion involved. The work piece moves in a straight line during its entire pass through the machine. The work piece is kept constantly under control. Even the forces applied by the sanding and shaping apparatus cannot cause the piece to bind or turn.

While this invention has been described in connection with a single embodiment thereof, it will be understood that this embodiment is capable of modification and that this application is intended to cover any variations, uses or adaptations following, in general, the principles of the invention and including such departures from the present disclosure as come within the known or customary practice in the art to which the invention pertains, and falls within the scope of the invention or the limits of the appended claims.

We claim:

1. A feeding and hold down mechanism comprising, in combination, a work surface, drive means, a plurality of feeding and hold down members individually connected to said drive means for motion in a substantially continuous loop over said work surface to feed and hold a work piece against the work surface as the work piece is conveyed along the work surface, wherein the feeding and hold down members are comprised of a pair of parallel spaced apart plate members disposed one above the other, means to pivotally interconnect said plate members so that the lower of the two plates yields vertically in parallel relation to the other plate, means to continuously urge said plate members apart, and resilient pad means fixed to said lower plate for engaging a work piece whereby said feeding and hold down mechanism imparts a vertical and horizontal component of force to the work piece as it travels with respect to the work surface.

2. A feeding and hold down mechanism acting in connection with a fixed work surface, said mechanism comprising, in combination:

drive means;

a plurality of feeding and hold down members connected to said drive means for motion in a substantially continuous loop above the work surface, said feeding and hold down members including:

a fixed upper plate connected to said drive means;

a movable lower plate, having a resilient pad affixed to the underside thereof for engaging a work piece;

means pivotally interconnecting said upper plate and lower plate and maintaining said plates in a spaced apart parallel relation; and means extending between said pivotal interconnecting means for urging said lower plate away from said upper plate whereby said lower plate may yield both vertically and laterally with respect to said upper plate to accept a work piece of varying thickness and to impart a vertical and horizontal component of force thereto to permit feeding and holding of said work piece during its travel.

3. A fedding and hold down mechanism as described in claim 2, wherein said means to urge said plates apart is a spring in compression.

4. A feeding and hold down mechanism for feeding and holding a work piece relative to a fixed work surface as the work piece is moved by the mechanism relative to the work surface, said mechanism comprising, in combination:

drive means disposed above the work surface;

a plurality of feeding and hold down members individually connected to said drive means for motion in a substantially continuous loop over the work surface, said feeding and hold down members comprised of an upper plate connected to said drive means and fixed with respect thereto, a lower plate pivotally connected to said upper plate and spaced apart therefrom, means to urge said plates apart and pad means connected to the underside of said lower plate to engage the work piece whereby each of said lower plates yields vertically and laterally as a work piece comes between the lower plate and the work surface and by action of said means urging said plates apart imparting a vertical and horizontal component of force to said work piece to hold it relative to said work surface as it is fed across by said mechanism.

5. A feeding and hold down mechanism as described in claim 4 wherein said drive means includes a pair of spaced apart chains driven in a continuous loop.

6. A feeding and hold down mechanism as described in claim 5, wherein said upper plate is connected to said spaced apart chains and are fixed with respect thereto.

7. A feeding and hold down mechanism as described in claim 4, wherein said means urging said plates apart is comprised of a spring in compression extending between said pivotal connecting means.

8. A feeding and hold down mechanism as described in claim 4, wherein said plates are pivotally connected by a pair of parallel spaced apart link means extending between said spaced apart plates, said plates and said link means forming a parallelogram and serving to maintain said plates in parallel relation as said lower plate moves with respect to said upper plate.

* * * * *